US006734381B2

(12) United States Patent
Mayo et al.

(10) Patent No.: US 6,734,381 B2
(45) Date of Patent: May 11, 2004

(54) WALLBOX DIMMER SWITCH HAVING SIDE-BY-SIDE PUSHBUTTON AND DIMMER ACTUATORS

(75) Inventors: Noel Mayo, Philadelphia, PA (US); Carl W. Gomes, Ocean, NJ (US); Elliot G. Jacoby, Glenside, PA (US); Roland L. Ledyard, Bethlehem, PA (US); Michael W. Pessina, Allentown, PA (US); Michael A. Ryan, Allentown, PA (US); Joel S. Spira, Coopersburg, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 85 days.

(21) Appl. No.: 10/011,039

(22) Filed: Nov. 13, 2001

(65) Prior Publication Data

US 2003/0089587 A1 May 15, 2003

(51) Int. Cl.[7] ..... H01H 3/00
(52) U.S. Cl. ..... 200/329; 200/345; 200/547
(58) Field of Search ..... 200/329, 547, 200/550, 549, 345, 333, 318, 321, 341

(56) References Cited

U.S. PATENT DOCUMENTS

| | | | | |
|---|---|---|---|---|
| 2,460,599 A | | 2/1949 | Rowe | 74/565 |
| 3,571,545 A | | 3/1971 | Haderer | 200/166 |
| 3,684,850 A | | 8/1972 | Kaderbek et al. | 200/166 |
| 3,939,318 A | | 2/1976 | Brown et al. | 200/159 R |
| 4,109,121 A | | 8/1978 | Bauer et al. | 200/67 E |
| 4,159,563 A | | 7/1979 | Bauer et al. | 29/622 |
| 4,352,964 A | | 10/1982 | English | 200/5 A |
| 4,672,229 A | | 6/1987 | Skarman et al. | 307/115 |
| 4,783,581 A | | 11/1988 | Flowers et al. | 200/332 |
| 4,822,963 A | | 4/1989 | Martin | 200/296 |
| 4,871,893 A | | 10/1989 | Slovak et al. | 200/16 R |
| 4,880,950 A | * | 11/1989 | Carson et al. | 200/547 |
| 4,886,946 A | * | 12/1989 | Franks, Jr. | 200/329 |
| 4,929,806 A | * | 5/1990 | Furuhashi et al. | 200/61.54 |
| 4,939,383 A | | 7/1990 | Tucker et al. | 307/139 |
| 4,947,054 A | | 8/1990 | Flowers et al. | 307/125 |
| 5,068,639 A | | 11/1991 | Swanson et al. | 338/179 |
| D337,755 S | | 7/1993 | Rowen et al. | D13/170 |
| 5,248,919 A | | 9/1993 | Hanna et al. | 315/291 |

(List continued on next page.)

OTHER PUBLICATIONS

NEMA Standards Publication No. ANSI/NEMA WD 6–2001, Wiring Devices–Dimensional Specifications, pp. 5 and 7.

Toggler® dimmer switch, Model TG–600PH, Lutron Electronics Co. Inc., Coopersburg, PA, known prior to Nov. 13, 2001.

DIVA Duo brand dimmer switch and wallplate, Model LDV–600P, Lutron Electronics Co. Inc., Coopersburg, PA, known prior to Nov. 13 , 2001.

(List continued on next page.)

*Primary Examiner*—Ann Mai
*Assistant Examiner*—K. Lee
(74) *Attorney, Agent, or Firm*—Drinker Biddle & Reath LLP

(57) ABSTRACT

A wallbox dimmer switch includes an actuator mounting frame having a platform portion that is receivable in a rectangular wallplate opening having standard toggle-type dimensions. The dimmer switch includes a pushbutton actuator for a switch and an adjacently located dimmer actuator that extend substantially parallel to a first side of the platform portion. The pushbutton actuator includes a user-engageable portion having an outer surface of which at least the end portions are defined by a portion of a substantially prolate spheroid for minimization of undesirable coupling between the adjacent actuators during actuation by a user. The switch may also include an actuator for an airgap switch extending through the platform portion and an array of indicator lights that are displayed through openings extending to an actuator-presentation surface of the platform portion.

38 Claims, 10 Drawing Sheets

U.S. PATENT DOCUMENTS

| | | | | | |
|---|---|---|---|---|---|
| 5,262,678 | A | | 11/1993 | Flowers et al. | 307/125 |
| D342,234 | S | | 12/1993 | Graybill, Jr. et al. | D13/169 |
| 5,338,910 | A | | 8/1994 | Tsai | 200/547 |
| 5,343,007 | A | | 8/1994 | Roeser et al. | 200/296 |
| 5,359,231 | A | | 10/1994 | Flowers et al. | 307/125 |
| D353,798 | S | | 12/1994 | Bryde et al. | D13/169 |
| 5,399,821 | A | | 3/1995 | Inagaki et al. | 200/341 |
| 5,428,674 | A | | 6/1995 | Kawashima | 379/100 |
| 5,446,252 | A | | 8/1995 | Burger | 200/329 |
| D364,141 | S | | 11/1995 | Hanna et al. | D13/125 |
| 5,558,209 | A | * | 9/1996 | Mohsen | 200/43.22 |
| 5,584,380 | A | | 12/1996 | Naitou | 200/315 |
| 5,608,196 | A | | 3/1997 | Hall et al. | 200/61.19 |
| 5,637,930 | A | | 6/1997 | Rowen et al. | 307/112 |
| 5,652,560 | A | * | 7/1997 | Carter et al. | 335/255 |
| 5,669,484 | A | | 9/1997 | Paulson | 200/43.22 |
| 5,721,405 | A | | 2/1998 | Hamada | 200/16 R |
| 5,753,983 | A | | 5/1998 | Dickie et al. | 307/141.4 |
| 5,821,482 | A | | 10/1998 | Ootani et al. | 200/5 A |
| 5,844,182 | A | | 12/1998 | Hirano et al. | 200/5 R |
| 5,881,866 | A | | 3/1999 | Miyajima et al. | 200/513 |
| 5,909,087 | A | | 6/1999 | Bryde et al. | 315/149 |
| 5,921,381 | A | * | 7/1999 | Von Arx | 200/345 |
| 6,005,308 | A | | 12/1999 | Bryde et al. | 307/157 |
| 6,013,885 | A | | 1/2000 | Kowalczyk | 200/315 |
| 6,017,585 | A | | 1/2000 | Thomas | 200/505 |
| 6,154,107 | A | * | 11/2000 | Tomotoshi | 335/205 |
| D439,220 | S | | 3/2001 | Mayo et al. | D13/125 |
| 6,518,867 | B2 | * | 2/2003 | Laskaris et al. | 335/299 |

OTHER PUBLICATIONS

Maestro® dimmer switch, Model MA–600H, Lutron Electronics Co. Inc., Coopersburg, PA, known prior to Nov. 13, 2001.

Lumes 2 brand dimmer switch, Model LTLV–603PH, Lutron Electronics Co. Inc., Coopersburg, PA, known prior to Nov. 13, 2001.

VAREO® dimmer switch, Model V–1000, Lutron Electronics Co., Inc., Coopersburg, PA, known prior to Nov. 13, 2001.

"Lutron® Residential Lighting Controls Catalog" by Lutron Electronics Co., Inc. of Coopersburg, PA, Oct. 31, 2001, pp. 30–32, 52–68 and 80–87.

Product literature for "Maestro® Electronic Low–Voltage Dimmers" by Lutron Electronic Co., Inc. of Coopersburg, PA, Dec. 2001, 2 pages.

Product literature for "Vareo® and NOVA T (star design)® Controls" by Lutron Electronics Co., Inc. of Coopersburg, PA, Dec. 1996, 2 pages.

* cited by examiner

FIG.2
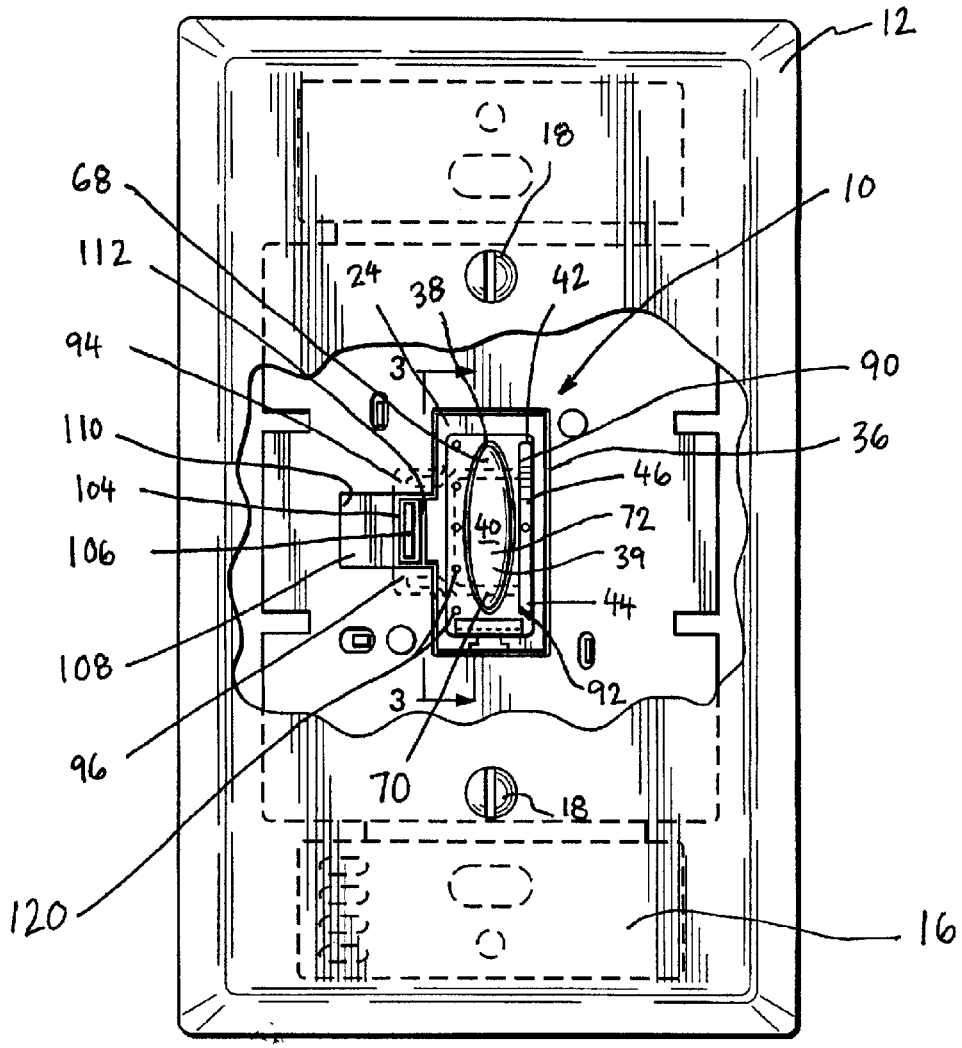
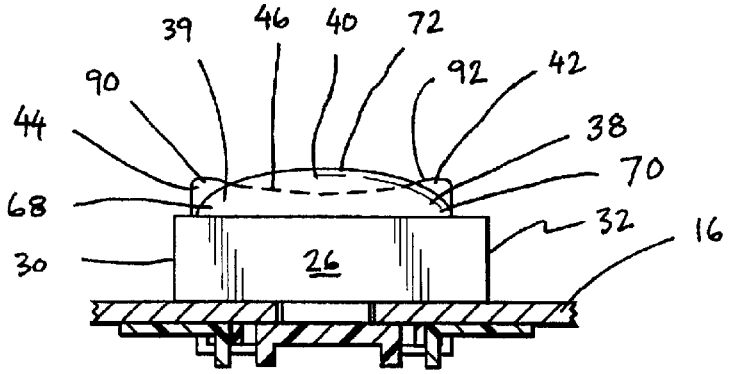
FIG.3

FIG.5E
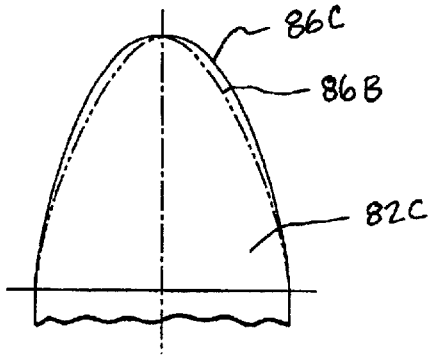
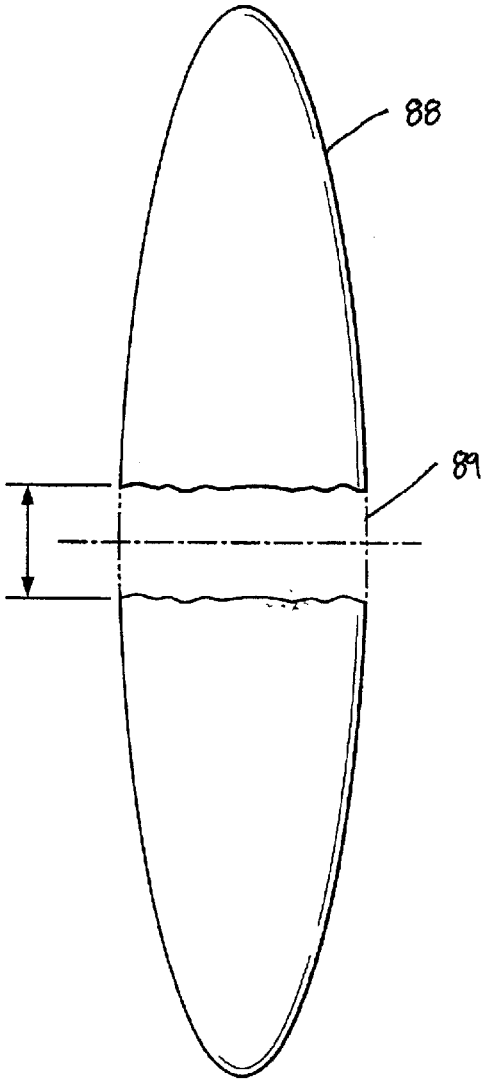
FIG.5F
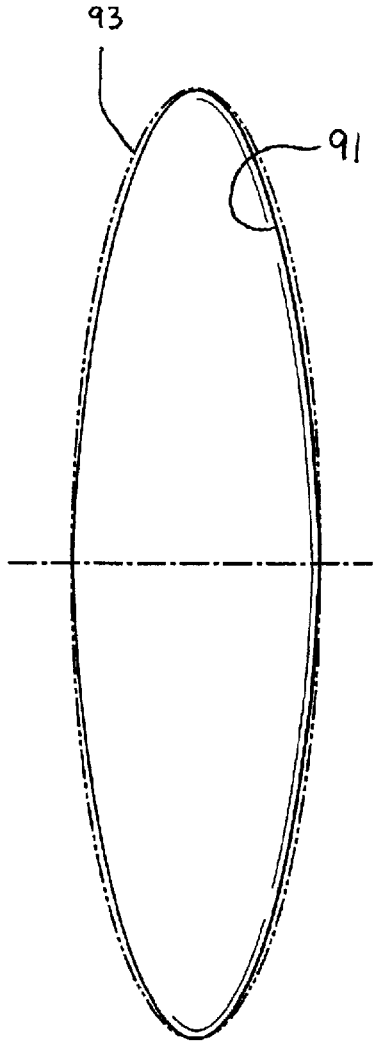
FIG.5G

FIG.9
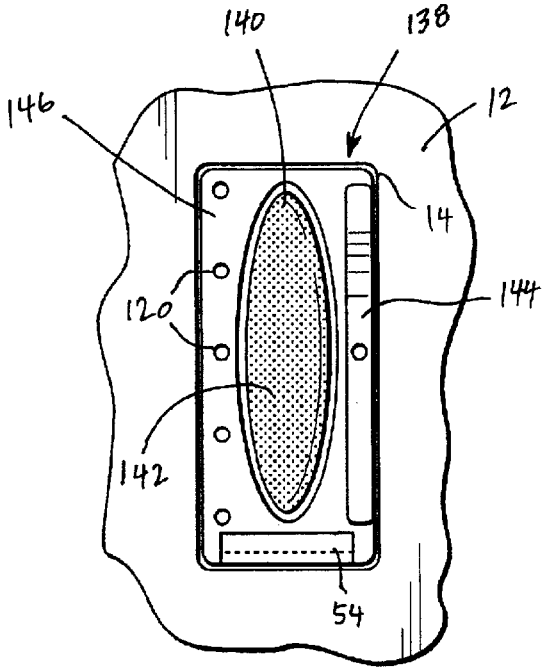
FIG.10
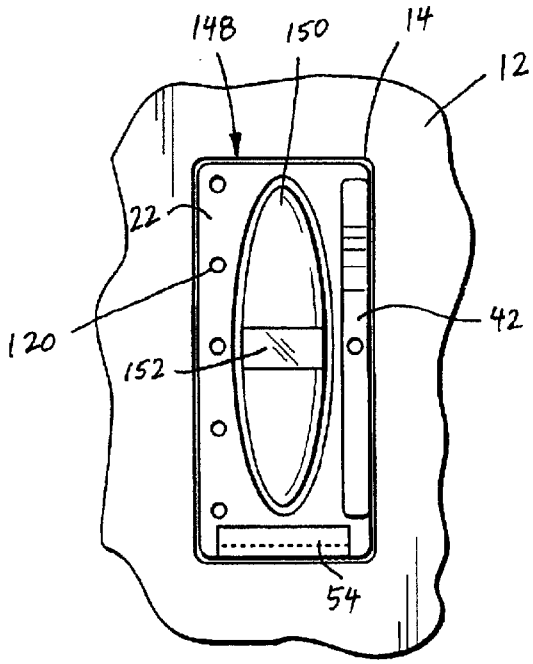
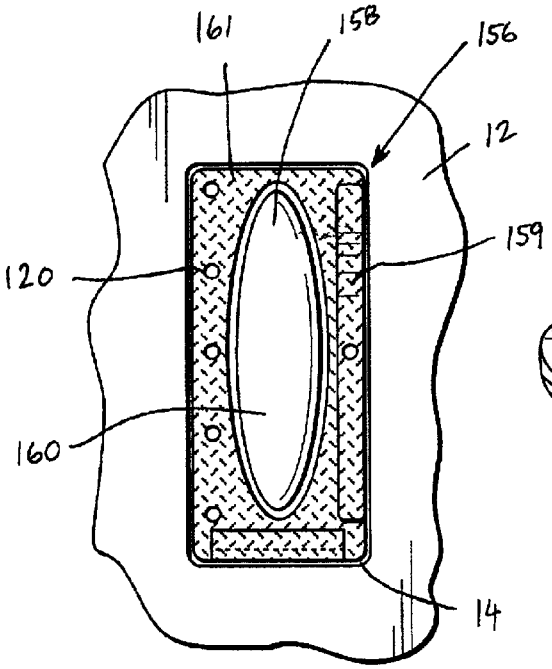
FIG.11
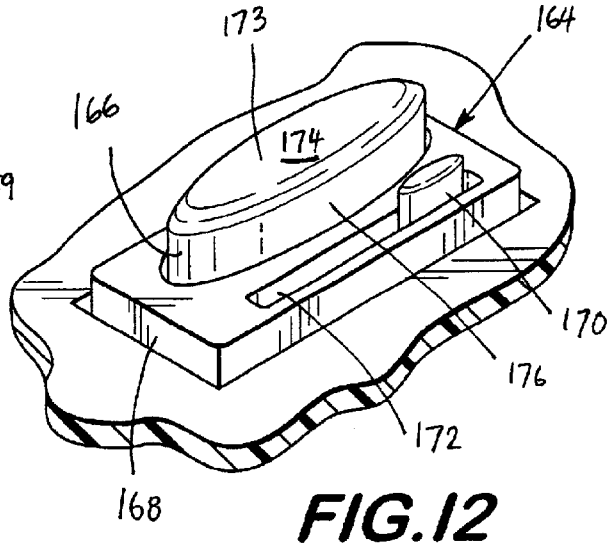
FIG.12

WALLBOX DIMMER SWITCH HAVING SIDE-BY-SIDE PUSHBUTTON AND DIMMER ACTUATORS

FIELD OF THE INVENTION

The present invention relates to a wallbox dimmer switch, and more particularly to a wallbox dimmer switch having a pushbutton on-off switch.

BACKGROUND OF THE INVENTION

Wall mountable load control devices for controlling an electrical load, such as a lamp, are well known. Known devices include conventional toggle switches which provide basic on/off control of an electrical load. Known devices also include dimmers which provide variation in the power supplied to a lamp. Known devices also include dimmer switches which provide independent on/off control and variable powering of a lamp.

Known wall mountable load control devices are typically mounted in an electrical wallbox and covered by a wallplate. The wallplate includes an opening that provides access to the actuator, or actuators, of the load control device. The device may be adapted to be compatible with an industry standard wallplate or may require a customized wallplate. Adapting the device for use with a standard wallplate provides for more universal application of the device. Standards published by the National Electrical Manufacturers Association (NEMA), and approved by the American National Standards Institute (ANSI), Publication No. ANSI/NEMA WD 6-2001, recognizes at least two principal standard wallplate dimensions for wall mounted switch devices. Arguably the most recognized of these are the wallplate dimensions for "toggle switch devices" (Page 7 of ANSI/NEMA WD 6-2001) that include a rectangular opening for a conventional on/off toggle switch. The NEMA standard also identifies dimensions of a wallplate for "rectangular face devices" (Page 5 of ANSI/NEMA WD 6-2001). The wallplate for "rectangular face devices" includes a much larger rectangular opening than the wallplate for "toggle switch devices". This wallplate is also sometimes referred to in the art as a "designer" wallplate.

Examples of devices combining on/off and dimmer functions, commonly referred to as dimmer switches, are found in U.S. Pat. No. 4,939,383 to Tucker et al., U.S. Pat. No. 5,359,231 to Flowers et al., U.S. Pat. No. 5,248,919 to Hanna et al. and U.S. Pat. No. 5,637,930 to Rowen. Each of these patents is commonly assigned to the assignee of the present invention. The '383 Tucker dimmer switch combines a dimmer slide with a pushbutton on/off switch. The dimmer slide operates in a relatively wide slot provided in a frame plate and is positioned vertically above the pushbutton actuator for the on/off switch. The pushbutton actuator extends through a second opening in the frame plate. The '383 dimmer switch is adapted to be used with the NEMA standard wallplate for "rectangular face devices".

The Flowers '231 dimmer switch includes a toggle actuator for actuating an on/off switch. The toggle actuator is positioned beside a dimmer actuator in which variations of the dimmer actuator include a dimmer slide, a rotary member and dimmer up/down buttons. The '231 dimmer switch is adapted to be used with the NEMA standard wallplate for "toggle switch devices".

Hanna '919 shows, in FIG. 1, a dimmer switch that is adapted for use with a wallplate having a large rectangular opening resembling the NEMA standard wallplate for "rectangular face devices". The switch includes an on/off switch actuator that presents a planar outer surface to a user of the switch. The on/off actuator is positioned adjacent a rocker dimmer actuator. The on/off actuator of the Hanna '919 dimmer switch is relatively large and occupies a substantial middle portion of the wallplate. The switch also includes an LED array that extends along one side of the on/off actuator opposite the rocker dimmer actuator.

Rowen '930 shows, in FIG. 1, a dimmer switch that includes an actuator having a planar outer surface for controlling an electronic touch switch. The planar actuator is located beside a dimmer actuator. The planar actuator for the touch switch extends substantially the entire height of the wallplate opening and for a majority of the width. The dimmer actuator operates vertically in a very narrow slot adjacent the touch actuator. Rowen '930 states that the dimmer switch of FIG. 1 could be adapted by scaling down the planar actuator for use with the NEMA standard wallplate for "toggle switch devices" (see col. 4, lines 20–22).

Rowen '930 shows, in FIGS. 5 and 5A, embodiments of dimmer switches in which the planar actuator is adapted for a mechanical switch to be received in a standard toggle switch wallplate opening along with a dimmer slide. In FIG. 5 of Rowen '930, the slide is located beside the planar actuator and moves in an out with the planar actuator. In FIG. 5A of Rowen '930, the dimmer slide is located within the on/off actuator. There is no teaching or suggestion in Rowen '930 that the actuator for the switch be modified to present a curved outer surface to the user.

SUMMARY OF THE INVENTION

According to the present invention there is provided an electrical load control device compatible with a wallplate having an opening that has standard dimensions for toggle-type switch devices. The electrical load control device includes an actuator mounting frame having a substantially rectangular platform dimensioned for receipt within the standard toggle-type wallplate opening. The device includes a dimmer actuator that extends in a direction that is substantially parallel with respect to a first side of the platform.

The device further includes a pushbutton actuator for a switch having a user-engageable portion that extends adjacent the dimmer actuator, the user-engageable portion defining a surface having opposite end portions that is presented to a user. At least the end portions of the surface of the user-engageable portion are defined by a portion of a substantially prolate spheroid to provide for minimization of undesirable coupling between the actuation of the adjacent actuators of the electrical load control device.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 2 is a front view of the dimmer switch of Figure with the wallplate partially removed;

FIG. 3 is a partial section view taken along the lines 3—3 of FIG. 2;

FIGS. 5A–5G illustrate the development of the pushbutton actuator of the preferred embodiment of FIG. 1;

FIG. 9 is a partial front view of a dimmer switch according to the present invention in which the pushbutton actuator presents a contrasting color to serve a targeting function;

FIG. 10 is a partial front view of a dimmer switch according to the present invention in which the pushbutton actuator includes an IR window;

FIG. 11 is a partial front view of a dimmer switch according to the present invention in which the surfaces presented by the switch have been given a surface treatment that serves to target the pushbutton actuator;

FIG. 12 is a partial perspective view of a dimmer switch according to the present invention in which the pushbutton actuator actuates a latching on-off switch;

DETAILED DESCRIPTION OF THE DRAWINGS

Figure 1:
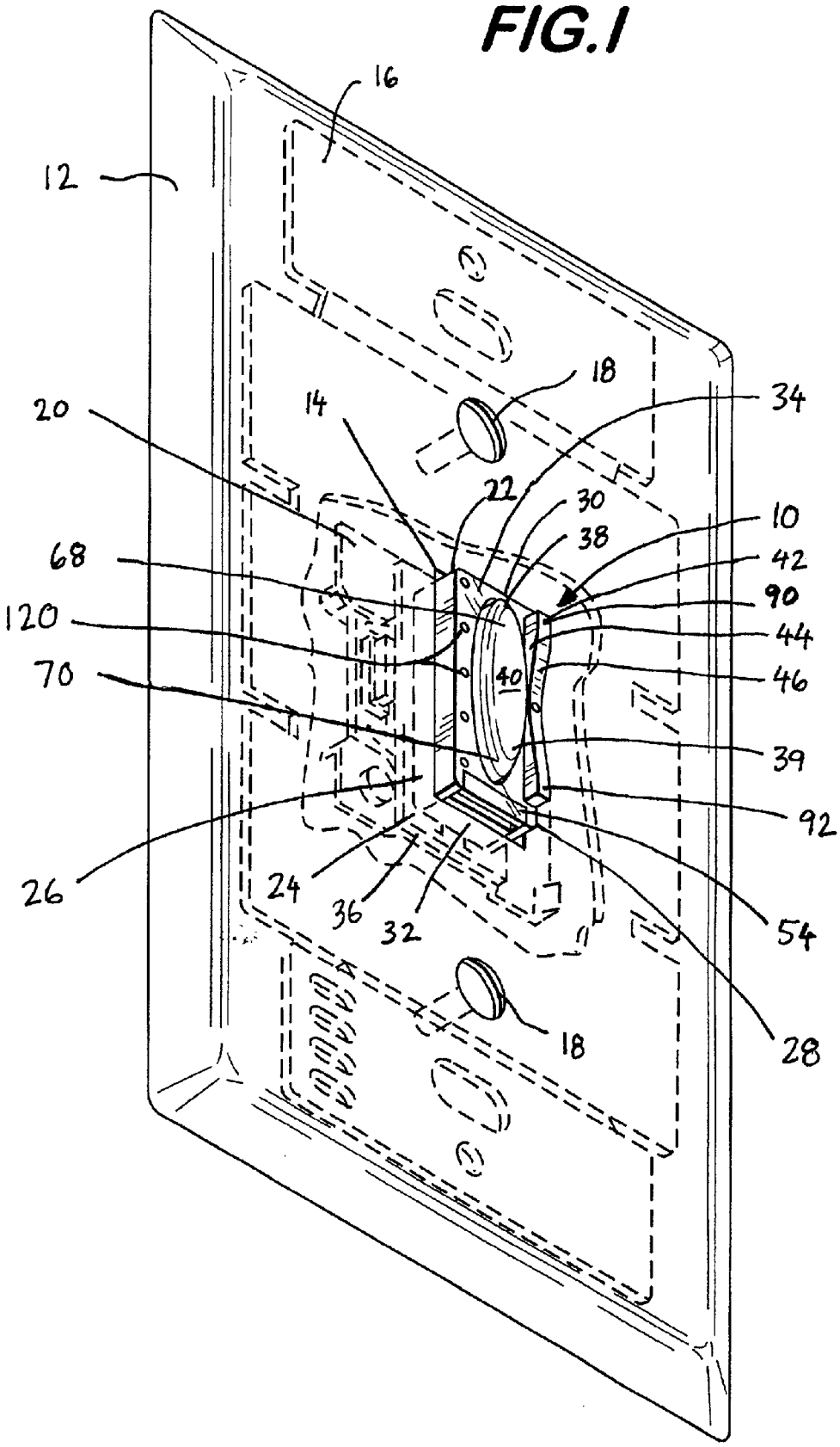
FIG. 1 is a perspective view of a dimmer switch according to the present invention received in the rectangular opening of a standard toggle wallplate.

Referring to the drawings where like numerals refer to like elements, there is shown in FIGS. 1–8 a wall mountable dimmer switch 10 according to the present invention. As seen in FIG. 1, the dimmer switch 10 is adapted for use with a standard toggle-type wallplate 12 having a rectangular opening 14. The term "toggle-type" as used herein, is meant to identify a wallplate that includes an opening having dimensions that conform to the standard dimensions printed on Page 7 of Publication No. ANSI/NEMA WD 6-2001, or to identify the opening of such a wallplate. The NEMA standards require that the width of the rectangular opening 14 of a conforming toggle-type wallplate be no less than 0.401 inches and that the height be no less than 0.925 inches. The standard dimensions for the toggle-type opening 14 therefore establish the maximum dimensions that may be occupied by the portion of the dimmer switch 10 which is adapted for receipt by the opening 14. The toggle-type wallplate 12 is shown secured to a yoke 16 by mounting screws 18. The yoke 16 is adapted for mounting to an electrical wallbox of a dwelling or other structure for example.

The dimmer switch 10 includes an actuator mounting frame 20 having a platform portion 22 that extends from a flange-like base 24. The platform portion 22 has outer surfaces defining a substantially rectangular structure for housing the actuators of the dimmer switch 10 as will be described in greater detail. The outer surfaces of the platform portion 22 include relatively long side surfaces 26, 28 and relatively short end surfaces 30, 32. The outer surfaces of platform 22 also include a surface 34 that extends between the side and end surfaces and that has openings to provide for presentation of the actuators to a user of the dimmer switch 10. As best seen in FIG. 2, the mounting frame 20 is received by the yoke 16 such that the flange-like base 24 is received within an opening 36 of the yoke 16. The length of the side surfaces (26, 28) is slightly less than the minimum height for a NEMA standard toggle-type opening, 0.925 inches. The length of the end surfaces (30, 32) is slightly less than the minimum width for a NEMA standard toggle-type opening, 0.401 inches. This ensures that the platform portion 22 will be receivable by the opening 14 of wallplate 12 as seen in FIG. 1.

Figure 4:
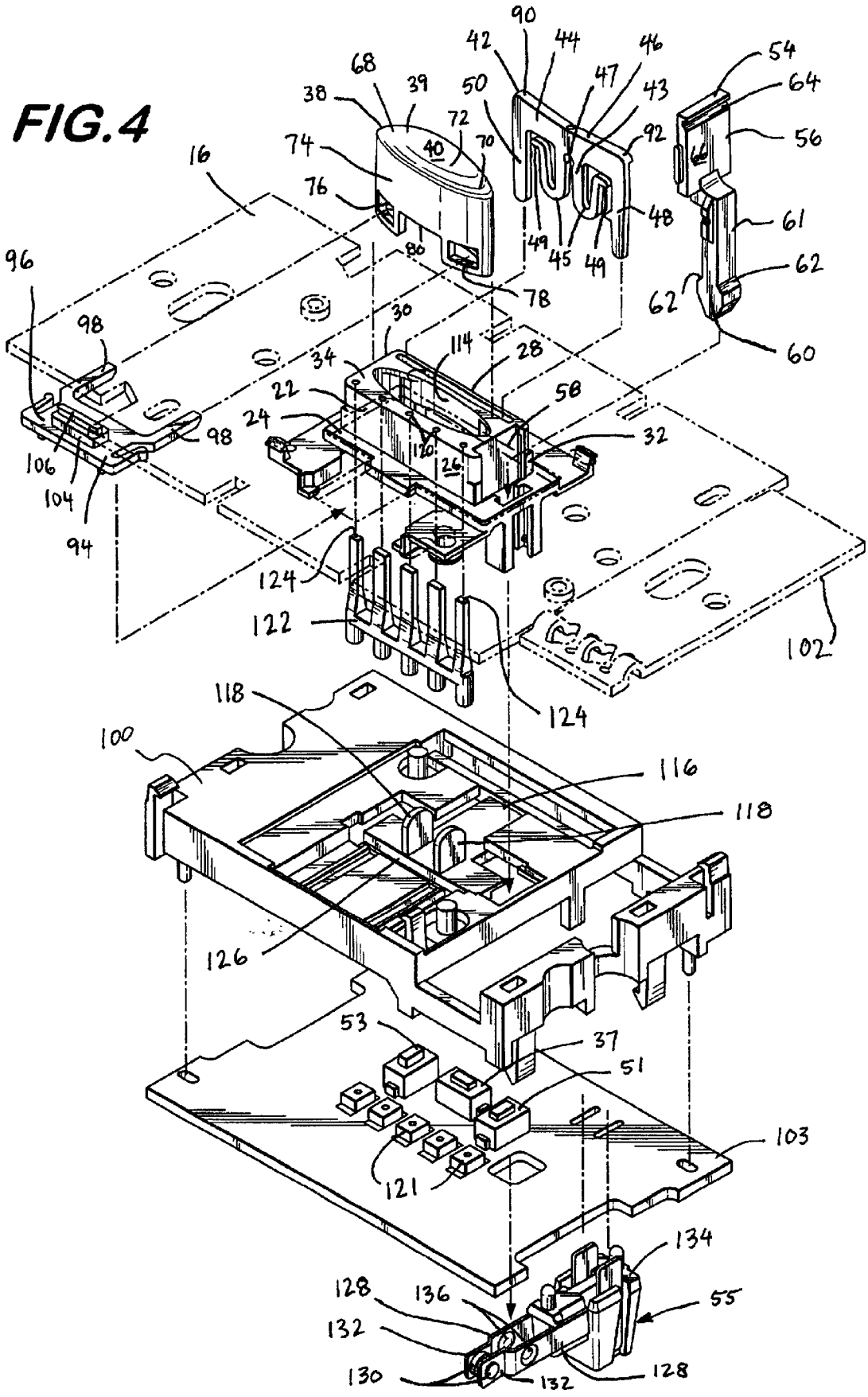
FIG. 4 is an exploded perspective view of the dimmer switch of FIG. 1.

The actuators supported by the platform portion 22 include a pushbutton actuator 38 for operating an on-off switch 37 (FIG. 4). The pushbutton actuator 38 includes an elongated user-engageable portion 39 that defines an outer surface 40 that is presented to a user of the dimmer switch 10. As will be described in greater detail, the outer surface 40 of the user-engageable portion 39 is substantially a hemi-ellipsoidal surface. The outer surface 40 of the user-engageable portion 39 extends generally parallel to the long side surfaces 26, 28 of the platform portion 22. Translation of the pushbutton 38 with respect to the platform portion 22, through engagement with the outer surface 40 by the finger of a user for example, operates the on-off switch 37. As will be described in greater detail, the pushbutton 38 is flexibly supported such that the pushbutton 38 will return following the release of the user-engageable portion 39 by a user of the dimmer switch 10.

The group of actuators supported by the platform 22 also includes a rocker dimmer actuator 42 for varying power to an electrical load controlled by the dimmer switch 10. As best understood with reference to FIG. 4, the rocker dimmer actuator 42 includes an elongated member 44 that presents a surface 46 to a user of the dimmer switch 10. The elongated member 44 extends adjacent to the user-engageable portion 39 of pushbutton 38 in a direction that is substantially parallel to the long side surfaces 26, 28 of the platform 22. As seen in FIG. 2, the elongated member 44 of the rocker dimmer actuator 38 extends along a length of the actuator-presentation surface 34 of the platform portion 22 that is substantially equal to that of the outer surface 40 of pushbutton actuator 38.

The rocker dimmer actuator 42 further includes legs 48, 50 that extend from opposite ends of the elongated member 44. The elongated member 44 includes a support member 43 opposite the presented surface 46. The support member 43 includes opposite arms 45 that define a centrally located notch 47 adapted for snap receipt of a cooperatively formed element (not shown) carried by the platform portion 22. The support of the centrally located notch 47 in this manner provides for pivot of the rocker dimmer actuator 42 with respect to the platform portion 22. As seen in FIG. 4, each of the arms 45 of support member 43 is substantially U-shaped and includes outwardly extending ends defining planar support surfaces 49. The planar support surfaces 49 contact elements (not shown) that are carried by the platform portion 22. The construction of the arms 45 serves to bias the rocker dimmer actuator towards an unpivoted orientation with respect to the platform portion in the following manner. Pivoting of the rocker dimmer actuator 42 about the notch 47 will result in flexing of one of the arms 45. Upon release of the rocker dimmer actuator 42 by a user, the rocker dimmer actuator 42 will be urged to return to the unpivoted orientation.

The ends of the legs 48, 50 that are opposite the elongated member 44 actuate lower and raise switches 51, 53 (FIG. 4) depending on which end of the presented surface 46 is engaged by a user of the dimmer switch 10. The lower and raise switches 51, 53 provide for, respectively, a decrease or an increase in the amount of power that is supplied to an electrical load being controlled by the dimmer switch 10. The use of a rocker dimmer actuator 42 for control of the lower and raise switches 51, 53 is preferred over the use of independent actuators for the switches 51, 53 since this ensures that the user does not simultaneously operate the switches 51, 53. Dimming through the use of lower and raise switches is per se well known in the art and therefore no further description is required.

The switch 37 of the dimmer switch 10 of FIGS. 1–8 is an electronic switch that does not create an airgap between the source of AC power and the electrical load when the switch is turned off. The electronic dimmer switch 10 includes an actuator 54 that engages an airgap switch 55. The airgap switch 55 functions to ensure that no current will reach an electrical load controlled by the switch 10 when the airgap switch actuator 54 is actuated. This is desirable for situations where close contact with the electrical load is required, for maintenance or repair of the electrical load for example. An airgap switch is required in order to obtain a listing for a dimmer switch under Underwriters Laboratory (UL) Standard 1472.

The airgap switch actuator 54 includes a plate portion 56 that is slidably received within a recess 58 formed in short side 32 of platform 22. The airgap switch actuator 54 is supported for translation of the airgap switch actuator 54 with respect to the platform portion 22 in a direction that is substantially perpendicular to the actuator-presentation surface 34. The airgap switch actuator 54 further includes a wedge element 60 that is connected to the plate portion 56 by an elongated stem 61. The wedge element 60 includes outwardly directed cam surfaces 62. As will be described in greater detail below, translation of the airgap actuator 54 causes the wedge element 60 to engage the airgap switch 55 and open an electrical circuit. The opening of the circuit prevents current from being directed to the electrical load. The plate portion 56 of the airgap switch actuator 54 includes a recess 64 in a surface 66. The recess 64 facilitates engagement of the plate portion 56 by a user of the dimmer switch 10 for translation of the airgap switch actuator 54.

The present invention limits the potential for incorrect actuation of the actuators that is created by the side-by-side positioning of the pushbutton actuator and the rocker dimmer actuator within the confines of the standard toggle-type opening. The incorrect actuation may involve actuation of one of the actuators when the actuation of the other actuator was intended. This involves an independent actuation of one of the actuators. The incorrect actuation may also involve a coupling of the actuation of the pushbutton actuator with the actuation of the adjacent dimmer actuator. Coupled actuation is rendered more likely when a pushbutton actuator is positioned adjacent a rocker dimmer actuator because the actuation of the respective actuators involves motion of the acutator in substantially similar directions. The present invention facilitates independent and correct actuation of the side-by-side pushbutton actuator 38 and rocker dimmer actuator 42 by shaping the outer surface 40 of the user-engageable portion 39 to have the substantially hemi-ellipsoidal shape shown. The substantially hemi-ellipsoidal shape minimizes the prominence of opposite ends 68, 70 of the outer surface 40 with respect to the actuator-presentation surface 34 of platform portion 22. The hemi-ellipsoidal shape for the outer surface 40 of the user-engageable portion 39 also maximizes the prominence of a middle portion 72 of the user-engageable portion 39 with respect to the platform portion 22. As a result of shaping the user-engageable portion 39 in this manner, the middle portion of the pushbutton actuator 38 is targeted for engagement by a user of the dimmer switch 10.

As seen in FIG. 2, the hemi-ellipsoidal shape for the outer surface 40 of the user-engageable portion 39 of pushbutton 38 also minimizes the lateral dimensions of the end portions 68, 70 relative to the lateral dimensions of the middle portion 72. The user-engageable portion 39 thereby tends to swerve away from the adjacent rocker dimmer actuator 42 at the opposite ends such that the lateral separation between the end portions 68, 70 of the user-engageable portion 39 and the rocker dimmer actuator 42 is increased.

The term "ellipsoid" as used herein is meant to identify "a surface all plane sections of which are ellipses." See Webster's Third New Dictionary of the English Language Unabridged, Merriam Webster, Inc., 1993, pg. 737. The term "hemi" is meant to identify that the surface is a portion of an ellipsoid. The term "substantially" is meant to identify that the plane sections will not necessarily be mathematically true ellipses.

The preferred shape for the outer surface 40 of the user-engageable portion 39 is also described herein as being defined by a portion of a substantially prolate spheroid. The term "prolate spheroid" as used herein is meant to identify "an ellipsoid of revolution generated by revolving an ellipse about its major axis." See Webster's Third New International Dictionary of the English Language Unabridged, Merriam Webster, Inc., 1993, pg. 1814. The term "substantially", as used with "prolate spheroid" herein, identifies that a base cross section of the user-engageable portion 39 of the actuator 38 (i.e., the cross section of the user-engageable portion 39 at the intersection of the user-engageable portion and a body portion 74 of the pushbutton actuator 38) need not be a mathematically true ellipse (i.e., "a closed plane curve generated by a point so moving that its distance from a fixed point divided by its distance from a fixed line is a positive constant less than 1"; pg. 737 of the above-identified Webster's Third.) The term "substantially", as used herein with "prolate spheroid" also identifies that the user-engageable portion 39 need not be a portion of a true surface of revolution that is formed by revolving the base cross section about its major axis.

Referring to FIG. 4, the pushbutton actuator 38 is shown removed from the platform portion 22. As discussed above, the body portion 74 is substantially ellipsoidal in cross section. The pushbutton actuator includes spaced openings 76, 78 on both sides of the body portion 74 to provide passageways extending through the body portion 74. The pushbutton 38 further includes indented edges 80 on both sides of the body portion 74 between the openings 76, 78. The purpose of openings 76, 78 and the indented edges 80 will be described in greater detail hereinafter.

As discussed above, the preferred shape for the outer surface 40 of the user-engageable portion 39 of pushbutton actuator 38 is not a true prolate spheroid formed by revolving an ellipse about its major axis. Referring to FIGS. 5A–5G, some of the major modifications involved in the development of the preferred shape for the outer surface 40 will be described.

Figure 5A:
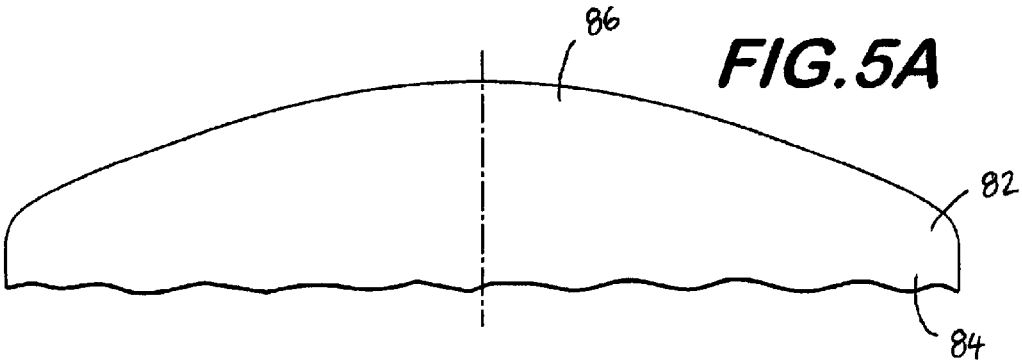
Figure 5B:
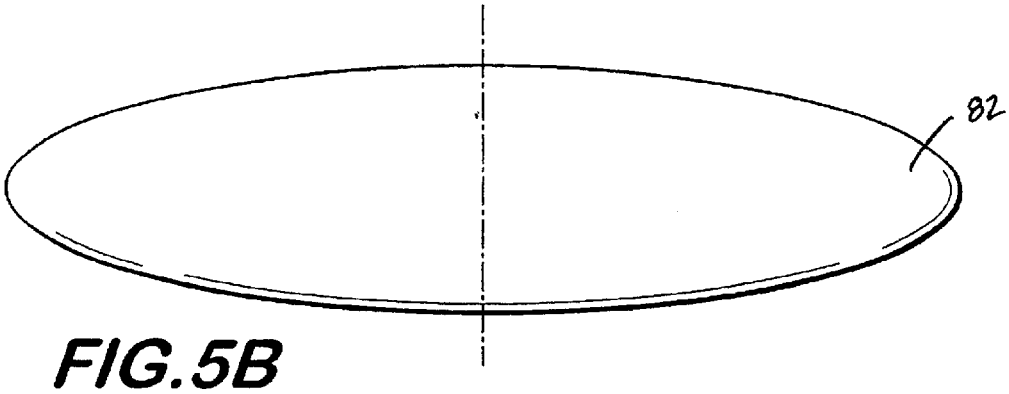

In FIGS. 5A and 5B, a pushbutton actuator 82 is shown having a body portion 84 and a user-engageable portion 86. The body portion 84 of the pushbutton actuator 82 has a cross section that is defined by a true ellipse. The user-engageable portion 86 is a portion of a true prolate spheroid that is obtained by revolving the elliptical cross section of the base portion 84 about its major axis.

Figure 5C:
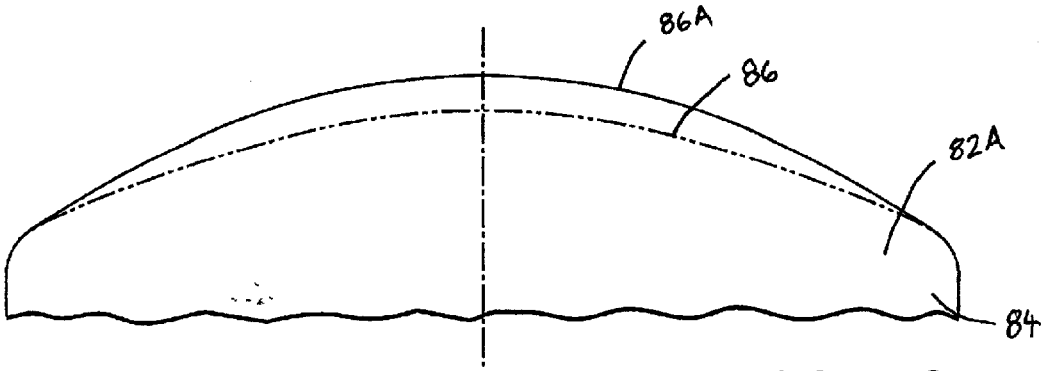

Turning to FIG. 5C, there is shown a pushbutton actuator 82A that is a modified version of the pushbutton actuator 82 of FIGS. 5A and 5B. A body portion 84 of the pushbutton actuator 82A is similar to the body portion 84 of pushbutton actuator 82. The user-engageable portion 86A of pushbutton actuator 82A (which is shown in solid line) has been modified from the user-engageable portion 86 of pushbutton actuator 82 (shown in dashed line) formed by revolving the base cross section about its major axis. The distance that the user-engageable portion extends from the body portion has been increased in the middle of the actuator. This relative elongation of the middle portion of the user-engageable portion has the effect of rendering the middle portion more prominent relative to remaining end portions of the user-engageable portion.

Figure 5D:
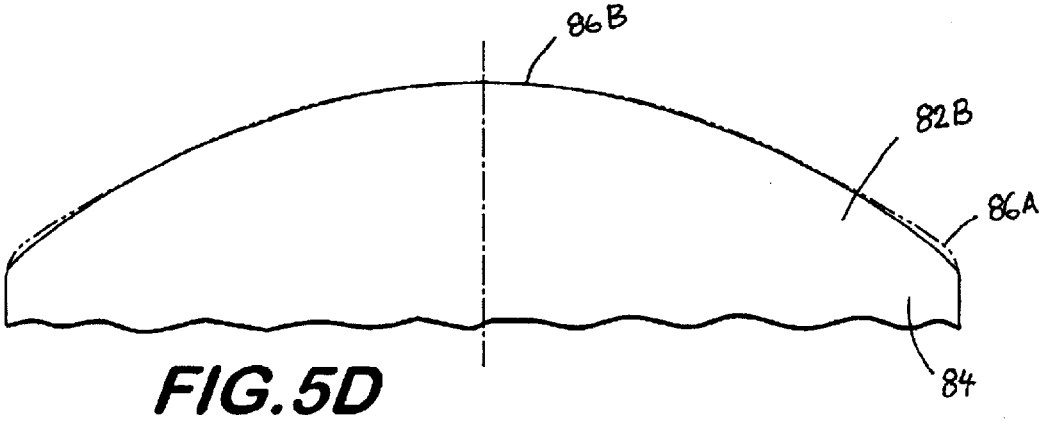

In FIG. 5D, the user-engageable portion 86B of pushbutton actuator 82B (shown in solid line) has been further modified from the user-engageable portion 86A of pushbutton actuator 82A (shown in dashed line). The opposite ends of the user-engageable portion have been modified by reducing the distance that the end portions of the user-engageable portion extend from the body portion 84. The reduction in the extension of the end portions of the user-engageable portion reduces the prominence of the opposite end portions with respect to the middle portions.

The above-described modification illustrated in FIGS. 5C and 5D, results in an outer surface of user-engageable portion 86B that may feel sharp to a user engaging the actuator 82B. Accordingly, as shown in the end view of the pushbutton actuator in FIG. 5E, the most remote portions of the user-engageable portion 86B (shown in dashed line) from the body portion 84B have been rounded. The modified pushbutton actuator 82C having user-engageable portion 86C is shown in solid line. The rounding of those portions most likely to be contacted by a user (e.g., the remotest portions of the user-engageable portion) serves to reduce the sensation of sharpness of the user-engageable portion.

Referring to FIG. 5F, there is illustrated a further modification that was made to obtain the preferred outer surface 40 shown in the FIGS. 1–4. As described above, the pushbutton actuator 82 of FIGS. 5A and 5B includes a body portion 84 having a truly elliptical cross section. A true ellipse 88 is shown in FIG. 5F. A middle portion 89 of the true ellipse is shown in dashed line. In combination with the modifications described above, the preferred outer surface 40 is obtained by modifying the true ellipse 88 in the following manner. The middle portion 89 of the true ellipse 88 is removed and the remaining portions brought together to form the shortened ellipse 91 shown in FIG. 5G in solid line. The shortened ellipse 91 is compared in FIG. 5G with a second true ellipse 93 having the same length and width as the shortened ellipse 91. Because the end portions of the shortened ellipse 91 are derived from the more elongated true ellipse, the end portions are narrower than those of the second true ellipse 93 of the same length. As seen in FIG. 5G, the modified ellipse 91 will therefore provide increased separation between the end portions of the user-engageable portion 39 and rocker dimmer actuator 42.

To further facilitate independent engagement of the pushbutton actuator 38 and rocker dimmer actuator 42, the elongated member 44 of the rocker 42 is curved such that surface 46 is a concave surface. As best seen in FIG. 3, the opposite ends 90, 92 of the concavely curved surface 46 extend to a perpendicular distance away from the actuator-presentation surface 34 of platform portion 22 that is greater than that of the end portions 68, 70 of the pushbutton 38. Thus, the portions of the rocker actuator surface 46 that will be engaged by a user, namely the ends 90, 92, will be more prominent than the adjacent portions of the pushbutton actuator outer surface 40. As may also be seen in FIG. 3, the middle portion 72 of the pushbutton outer surface 40 extends to a perpendicular distance away from the platform portion 22 that is greater than that of any portion of the rocker actuator surface 46. Thus, the middle portion 72 forms the most prominent portion presented to a user of the dimmer switch 10.

Referring again to FIG. 4, additional features of the present invention will be described. The dimmer switch includes a clip 94 that provides for removable securement of the pushbutton actuator 38 within the dimmer switch 10. The clip provides for removal and replacement of the pushbutton actuator 38 following removal of the wallplate 12 without the further need for removal of mounting screws (not shown) that secure the dimmer switch 10 to an electrical wallbox in order to gain access to the rear of the dimmer switch. The clip 94 includes a plate portion 96 and spaced prongs 98 that extend generally parallel to the plate portion 96 from an edge of the plate portion. The spacing of the prongs 98 is substantially equal to that of the openings 76, 78 in the pushbutton actuator 38 to provide for receipt by the prongs within the openings 76, 78.

Figure 6:
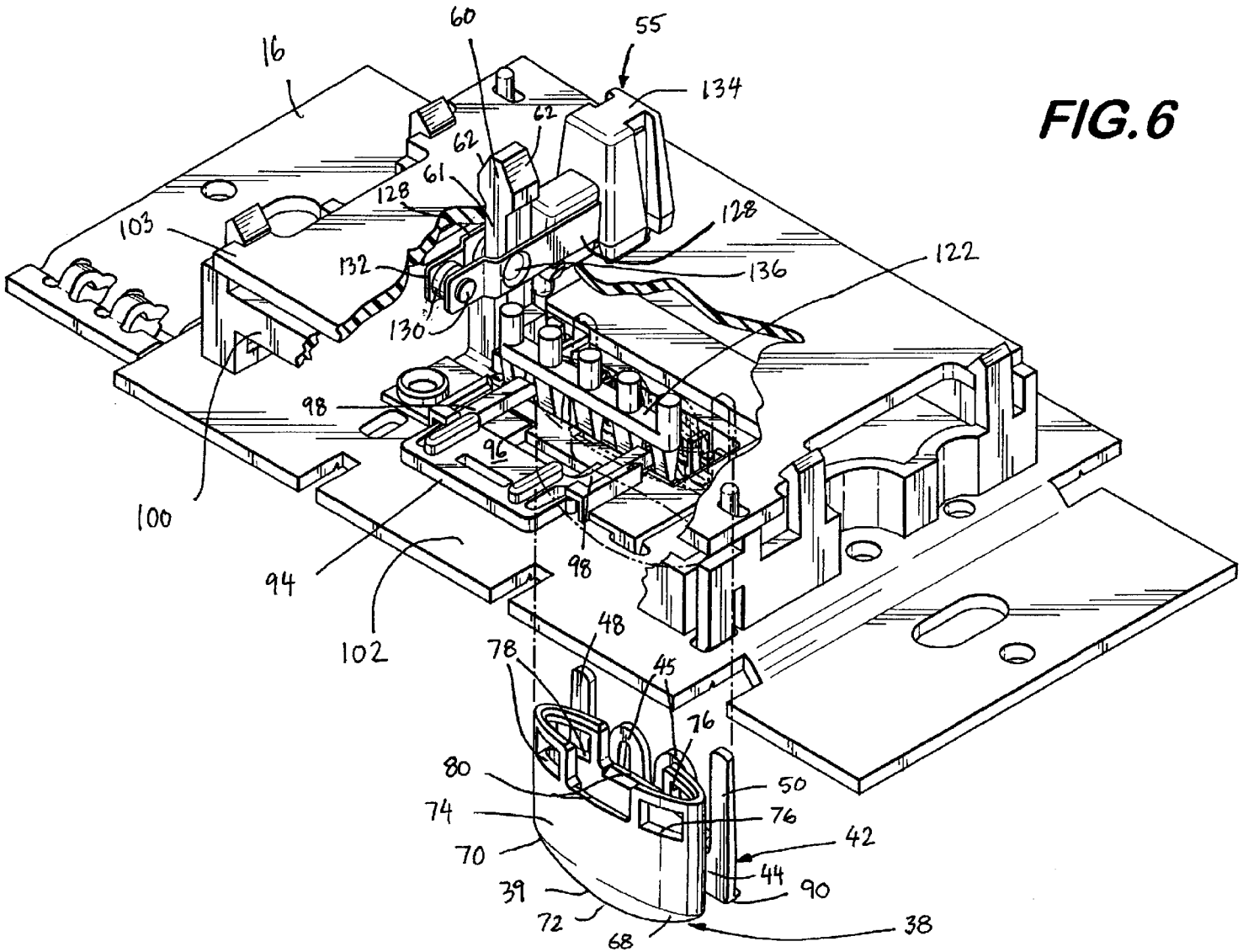
FIG. 6 is a rear perspective view of the dimmer switch of FIG. 1.

Referring to FIG. 6, the dimmer switch includes a sub-frame 100 that is positioned between the rear side 102 of yoke 16 and a printed circuit board 103 that supports the on-off switch 37 and the lower and raise switches 51, 53 (FIG. 4). The clip 94 is positioned between the rear side 102 of yoke 16 and the sub-frame 100 such that the clip 94 is translatable with respect to the dimmer switch in a direction that is generally perpendicular to the direction of translation for the pushbutton actuator 38. The clip 94 includes a first projection 104 that extends from the plate portion 96 and a second narrower projection 106 that extends from the first projection 104.

As best seen in FIG. 2, the yoke 16 includes an opening 108 that extends from one side of the opening 36. The opening 108 in the yoke 16 provides for access to the clip through the yoke 16. The projections 104, 106 serve two functions. They serve as a stop to limit the translation of the clip 94 between edge 110 of opening 108 and edge 112 of the base frame 24 of the mounting frame 20. The narrower outer projection 106 also serves to facilitate engagement of the clip 94 by a user of the dimmer switch 10 to translate the clip. Translation of the clip 94 towards the edge 110 of opening 108 retracts the prongs 98 from the openings 76, 78 of the pushbutton actuator 38 allowing for removal of the pushbutton actuator 38 from an opening 114 in platform 22 in which the actuator is received.

Referring again to FIG. 4, the sub-frame 100 includes a flexibly supported plate portion 116 having a pair of pedestal projections 118. The flexibly supported plate portion 116 is positioned between the pushbutton actuator 38 and the on-off switch 37 on the printed circuit board 103. The pedestal projections 118 are positioned on the flexibly supported plate 116 such when the pushbutton actuator 38 is secured in the platform 22 by clip 94, the indented edges 80 of the base portion 74 contact the pedestal projections 118. Translation of the pushbutton actuator 38 by a user of the switch 10 causes the plate portion 116 of sub-frame 100 to deflect toward the printed circuit board 103 resulting in actuation of the on-off switch 37. The openings 76, 78 in the pushbutton actuator 38 are oversized with respect to the prongs 98 of the securement clip 94 to provide sufficient clearance between the pushbutton actuator 38 and the clip 94 for the translation of the pushbutton actuator 38. Upon release of the pushbutton actuator 38 by a user of the dimmer switch 10, the return of the plate portion 116 to its undeflected position will urge the pushbutton actuator 38 towards its pre-translation position.

As seen in FIGS. 1, 2 and 4, the platform 22 includes an array of openings 120 that extend to the actuator-presentation surface 34 of the platform portion 22. The openings 120 provide for passage of light to the surface 34 from sources of light in light communication with the openings. The light sources are most preferably LEDs 121 (FIG. 4) that are supported on the printed circuit board 103.

As seen in FIG. 4, the dimmer switch 10 includes a light pipe 122 having a plurality of conduits 124 of equal number and spacing to the array of openings 120. The light pipe 122 is received within the mounting frame 20 such that the conduits 124 extend substantially all the way through the platform portion 22 between the openings 120 in the platform 22 and the sub-frame 100. Alternatively, light pipe 122 could extend all of the way through the platform portion 22 and even extend beyond actuator-presentation surface 34. As seen in FIG. 4, the sub-frame 100 includes an opening 126 to provide for passage of light through the sub-frame and into the spaced conduits 124.

The presentation of light through the array of openings 120 in platform 22 provides for indication of the power level being supplied to the electrical load that is controlled by the dimmer switch 10. A description of power level display in a dimmer switch through the use of an array of LEDs in light communication with spaced openings may be found in commonly assigned U.S. Pat. No. 5,248,919 to Hanna et al. which is incorporated herein by reference. The display of light through the openings 120 is not limited to display of power level. A single light source could be used to indicate status of the on-off switch for example. Alternatively, one or more sources of light could be used to function as a night light to facilitate engagement of the actuators when the dimmer switch 10 is located in a darkened area. It should be noted that the present invention is not limited to electrical load control devices incorporating a light source display. A dimmer switch according to the present invention, for example, could present the pushbutton actuator and dimmer actuator on the platform without any openings for a light source display.

Figure 7:
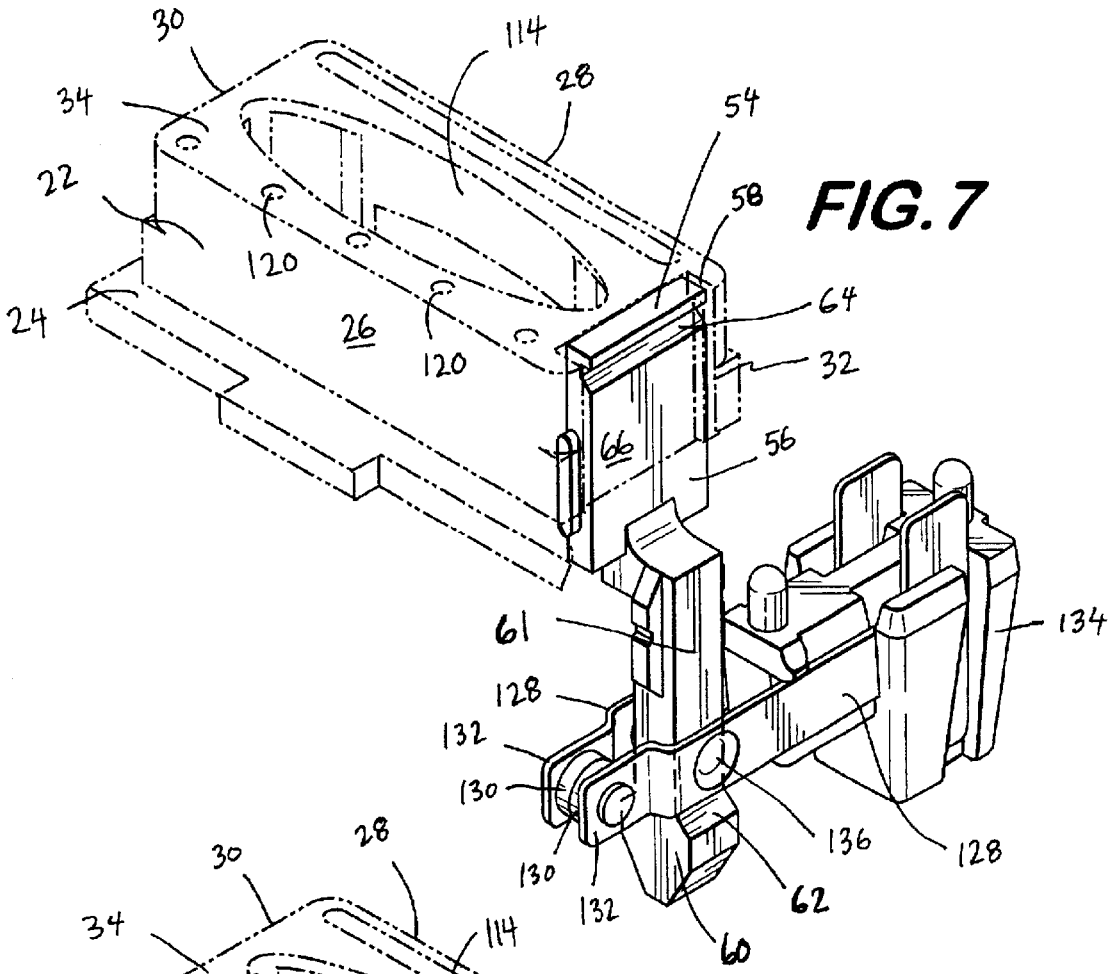
FIGS. 7 and 8 schematically illustrate the operation of the airgap switch of FIG. 1.
Figure 8:
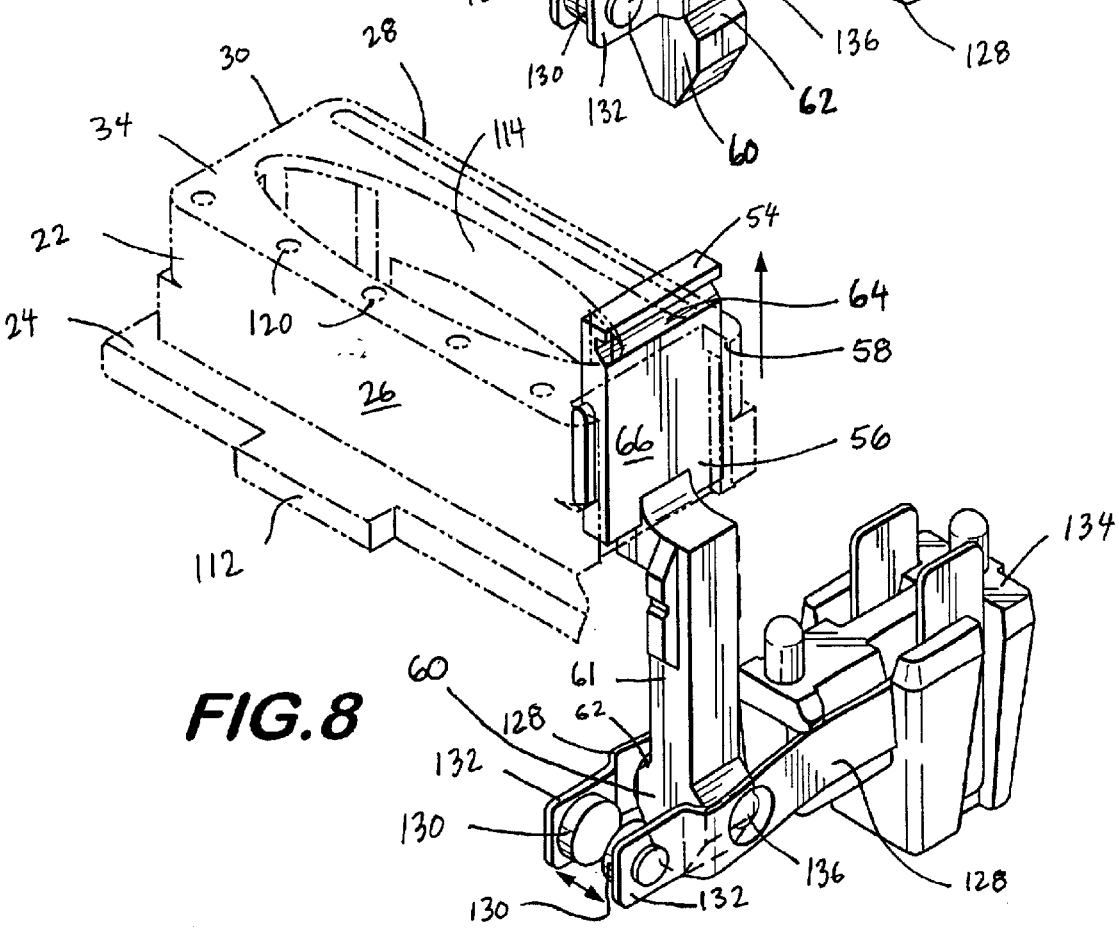

Referring to FIGS. 6–8, the operation of the airgap switch actuator 54 will be described in greater detail. As seen in FIG. 6, the dimmer switch 10 includes a pair of flexibly supported switch leaf arms 128 each supporting a conductive contact 130 at an end 132 thereof. The switch leaf arms are biased such that the contacts 130 are normally in contact with one another. Each of the switch leaf arms 128 is conductive and electrically connected to the circuit board 103 through a mounting element 134. The switch leaf arms 128 diverge from one another between the ends 132 and the mounting element 134 to provide for extension of the stem 61 of the airgap switch actuator 54 between the switch leaf arms 128 with the electrical contacts 130 in contact with one another. Each of the switch leaf arms 128 includes an inwardly directed projection 136 that is positioned to engage the cam surfaces 62 of the wedge element 60.

As seen in FIG. 8, translation of the plate 56 of airgap switch actuator 54 with respect to the platform 22 results in engagement of the cam surfaces 62 of wedge element 60 with the projections 136 of the switch leaf arms 128. This engagement forces the ends 132 of the switch leaf arms 128 and the associated contacts 130 to separate from one another thereby breaking the circuit and preventing current from being directed to the electrical load controlled by the dimmer switch 10. The receipt of the plate 56 within the recess of the platform 22 serves to conceal the airgap switch actuator in its retracted position. However, as seen in FIG. 8, when the actuator is translated to separate the switch leaf arms 128, the plate 56 extends above the platform. This prominent positioning of the extended plate 56 with respect to the platform 22 provides highly visible indication that the airgap switch has been actuated.

The platform portion 22 of dimmer switch 10 of FIGS. 1–4 is therefore capable of combining numerous functions, all within the constrained dimensions of the standard toggle wallplate opening. These features include pushbutton on/off switch actuation, dimmer lower and dimmer raise, airgap switch actuation, and light display capability. As described above, the light display feature can be used to perform various functions including power level indication, on/off status, and night lighting. In the manner well known in the art, the dimmer switch 10 includes a backcover (not shown) that is secured to the yoke 16 to enclose the printed circuit board 103 and the airgap switch 55.

Referring to FIG. 9, there is shown a dimmer switch 138 according to the present invention having a pushbutton actuator 140. The outer surface 142 of the user-engageable portion of the pushbutton actuator 140 presents a color that contrasts with that of the adjacent rocker dimmer actuator 144. Preferably the color of the pushbutton actuator 140 also contrasts with other exposed surfaces of the platform 146. The use of contrasting color for the outer surface 142 of the pushbutton actuator 140 serves to visually target the pushbutton actuator to facilitate the separate engagement of the pushbutton actuator 140 by a user of the dimmer switch 138. The contrasting color of the pushbutton actuator 140 is most preferably a color that is darker than that of other exposed surfaces.

Referring to FIG. 10, there is shown a dimmer switch 148 having a pushbutton actuator 150 in which a central portion of the user-engageable portion of pushbutton actuator 150 is infrared transmissive thereby forming an IR window 152. The IR window 152 permits passage of infrared through the user-engageable portion of the pushbutton actuator 150. As will be described in greater detail in regard to FIGS. 13 and 14, the inclusion of the IR window 152 provides for infrared communication between an IR preamp 153 supported on the printed circuit board 155 for dimmer switch 148 and a source of infrared located exteriorly of the dimmer switch. As seen in the FIG. 10, the location of the IR window 152 in the middle portion of the user-engageable portion of the pushbutton actuator 150 provides the additional function of distinguishing the middle portion of the pushbutton from the opposite end portions. This distinction serves to visually target the middle portion of the actuator thereby further facilitating the independent engagement of the actuator 150 by a user of the dimmer switch 148.

The targeting of the middle portion of the pushbutton actuator through the incorporation of the centrally located IR window 152 could be combined with the above-described use of contrasting color to distinguish the pushbutton actuator generally. The targeting of the central portion of the pushbutton outer surface could also be achieved by alternative means to the IR window that is shown in the drawings. The use of distinct coloring or other marking of the middle portion would also serve to target the middle portion of the pushbutton.

In FIG. 11, there is shown a dimmer switch 156 having a pushbutton actuator 158 in which the outer surface 160 presents a surface texture that presents a distinct appearance with respect to the appearance of the exposed surfaces of a rocker dimmer actuator 159 and platform 161. The distinctive appearance for the pushbutton actuator 158 is preferably obtained by providing the pushbutton with a glossy surface finish while providing other exposed surfaces of adjacent actuator 159 and the platform portion 161 with a matte finish. This distinctive appearance of the glossy finish serves to visually target the outer surface of the pushbutton actuator 158 thereby facilitating the independent engagement of the pushbutton actuator 158 by a user of the dimmer switch 156.

The above-description has focused on the benefits of increased lateral separation and visual targeting provided by shaping the outer surfaces of the side by side pushbutton actuator and rocker dimmer actuator in the disclosed manner. The distinctive shaping, however, also provides for tactile differentiation between the two actuators. The tactile response to engaging the convexly shaped outer surface of the pushbutton actuator contrasts with that of the concavely shaped outer surface of the rocker dimmer actuator. Such tactile differentiation facilitates operation of the dimmer switch in conditions of low lighting or darkness. Providing the respective outer surfaces with distinct surface treatments, such as the high gloss and matte finishes of the switch shown in FIG. 11, may further enhance the tactile differentiation.

Referring to FIG. 12, there is shown a dimmer switch 164 according to the present invention. The dimmer switch 164 includes a pushbutton actuator 166 supported in a platform 168 for translation of the pushbutton actuator 166 with respect to the platform 168 to actuate a latching on-off airgap switch. The dimmer switch 164 also includes a dimmer slide actuator 170 that is slidably received in an elongated slot 172. The pushbutton actuator 166 includes a user-engageable portion 173 having an outer surface 174 and a body portion 176. The outer surface 174 has a substantially prolate spheroid shape that is identical to that of the pushbutton actuator of the electronic dimmer switch 10 of FIGS. 1–4. The latching on-off airgap switch of dimmer switch 164 requires more force to operate and requires a larger translation of the actuator 166 for switch actuation than the on-off switch 37 of the electronic dimmer switch 10. Therefore, when the switch is either in the latched or unlatched position, the pushbutton actuator 166 will extend from the platform 168 such that a length of the body portion 176 will be exposed above he platform.

The above-described construction for the dimmer switch 164 provides advantages over the dimmer switch shown in U.S. Pat. No. 5,359,231 Flowers et al., for example, in which a toggle actuator is positioned adjacent a dimmer slide. The actuation of the toggle actuator of Flowers is substantially parallel to the actuation of the dimmer slide. This parallelism creates the potential for undesirable coupling between the actuation of the toggle and the actuation of the slide. In contrast, the construction of dimmer switch 164 provides for an actuation of the pushbutton actuator for the latching on-off airgap switch with a motion by the user that is substantially perpendicular to the motion that is required to operate the adjacent dimmer slide.

Figure 13:
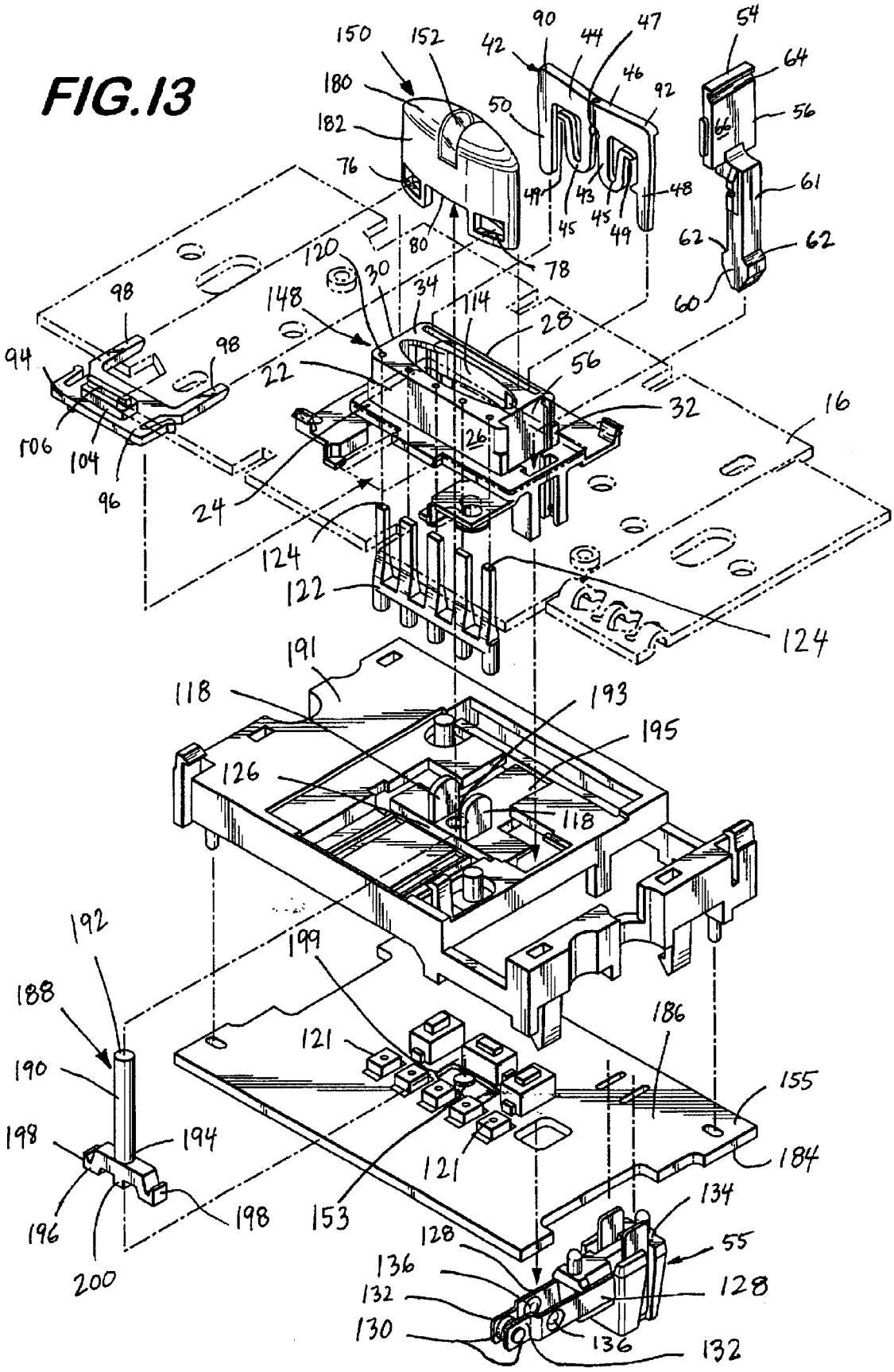
FIG. 13 is an exploded perspective view of a dimmer switch according to the present invention in which the pushbutton actuator includes an IR window.
Figure 14:
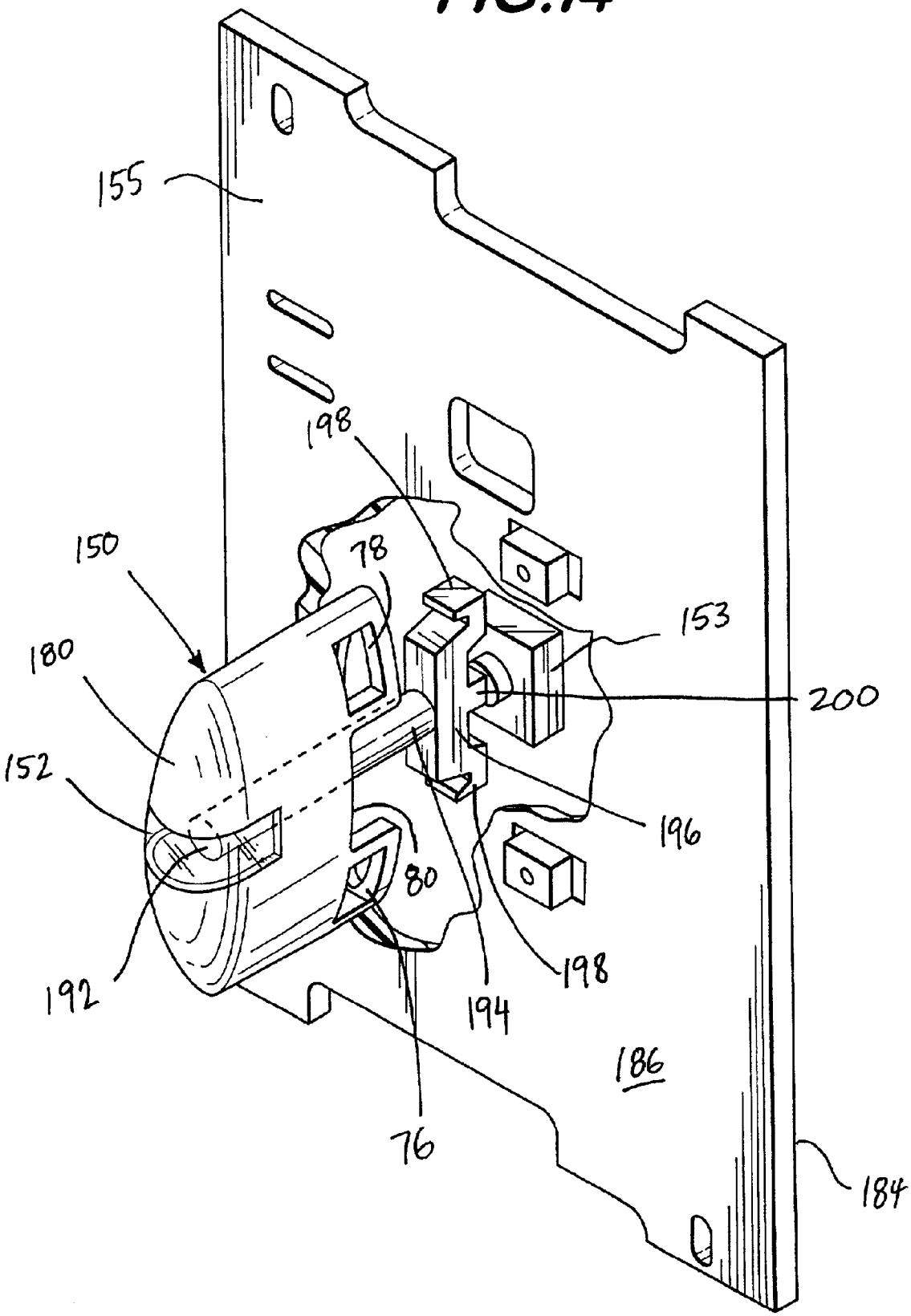
FIG. 14 is a partial perspective view of the dimmer switch of FIG. 13.

Referring to FIGS. 13 and 14, the construction of the dimmer switch 148 of FIG. 10 is shown in greater detail. As described previously, the pushbutton actuator 150 includes a centrally located IR window 152. The IR window is substantially in the form of a band that is curved to substantially match the contours of the adjacent portions of the pushbutton actuator 150. As seen in FIG. 13, the IR window extends across the user-engageable portion 180 of the pushbutton actuator 150 and has opposite end portions that extend into the body portion 182 of the pushbutton actuator. The IR window is made from a material that is transmissive to infrared radiation, most preferably a polycarbonate.

The IR preamp 153 is supported on the printed circuit board 155 on a side 184 of the printed circuit board 155 that is opposite from side 186. The dimmer switch 148 includes an IR light pipe 188 for conveying IR radiation to the preamp 153 that is directed through the IR window 152 from an external source of IR radiation, such as a hand-held remote transmitter for example (not shown). The IR light pipe 188 is made from an IR transmissive material and is preferably an IR transmissive polycarbonate. The light pipe 188 includes an elongated shaft portion 190 having a first end 192 that is positioned adjacent the IR window 152. The light pipe 188 also includes an attachment portion 196 connected to a second end 194 of shaft portion 190. The attachment portion 196 includes opposite arms 198 that are received by an opening 199 in the printed circuit board 155 to secure the light pipe 188 to the printed circuit board 155.

The flexible plate portion 195 of sub-frame 191 includes an opening 193 to accommodate the shaft portion 190 of light pipe 188. The supported light pipe extends through the plate portion 195 into the pushbutton actuator 150 as shown in FIG. 14. The IR preamp 153 is fastened to side 184 of the printed circuit board 155 in a manner well known in the art, such as by soldering. As shown in FIG. 14, the IR preamp 153 is secured to side 184 of printed circuit board 155 such that the preamp is positioned adjacent to an extension 200 of light pipe 188 that is connected to the attachment portion 196 opposite shaft 190.

As should be clearly understood by one skilled in the art, the described construction provides for conveyance of an IR signal that is directed into the dimmer switch 148 through the IR window 152 to the IR preamp 153 in the following manner. An IR signal directed through the IR window is directed into the first end 192 of the shaft portion 190 of light pipe 188. The IR signal is conveyed through the shaft portion 190 and the attachment portion 196 of light pipe 188. The signal is then transmitted into the IR preamp 153 via the extension 200 of attachment portion 196. The signal that is directed to the IR preamp can be an IR command signal that directs the dimmer switch to control dimmer raise, dimmer lower and on/off control of the dimmer switch in the manner known in the art. Such control over dimmer switch functioning in response to an IR signal directed to an IR preamp from an external source of IR is described in U.S. Pat. No. 5,909,087 which is incorporated herein by reference.

It is conceivable that alternative means to light pipe 188 could be used to direct the IR signal from the IR window 152 to IR preamp 153. For example, an IR lens could be used to direct the IR signal to the IR preamp 153. The invention is also not limited to an IR window that is centrally located with respect to the user-engageable portion of the pushbutton actuator. The IR window could alternatively be located along one of the opposite ends of the user-engageable portion.

Although the pushbutton actuator that presents the substantially prolate spheroid surface has been shown and described as part of a dimmer switch having additional actuators, the pushbutton actuator could alternatively be used as the sole actuator of an on-off switch, for example. Such an on/off switch could also include a single LED display for indication of on/off status of the on/off switch or for providing a night light for the on/off switch.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather should be construed in breadth and scope in accordance with the recitation of the appended claims.

What is claimed is:

1. An electrical load control device for use with a wall plate having an opening that has standard toggle-type dimensions, the electrical load control device comprising:

an actuator mounting frame comprising a substantially rectangular platform, the platform adapted for receipt within the switch opening of a standard toggle-type wallplate;

a dimmer actuator that extends in a direction that is substantially parallel to a side of the platform; and a pushbutton actuator for a switch comprising a user-engageable portion that extends adjacent the dimmer actuator in a direction that is substantially parallel to the first side of the platform, the user-engageable portion defining a surface having opposite end portions that is presented to a user of the device, at least the end portions of the surface of the user-engageable portion being defined by a portion of a substantially prolate spheroid to provide for minimization of undesirable coupling between the adjacent actuators during actuation by a user.

2. The electrical load control device according to claim 1, wherein the dimmer actuator comprises a pivotably supported rocker dimmer actuator, the rocker dimmer actuator having a portion defining a curved surface that is presented to a user of the device.

3. The electrical load control device according to claim 2, wherein the rocker dimmer actuator surface has opposite end portions and is substantially concave such that the end portions extend to a distance from the mounting frame that is greater than that for a middle portion of the rocker dimmer actuator surface.

4. The electrical load control device according to claim 2, wherein the user-engageable portion of the pushbutton actuator includes a middle portion that extends to a distance from the mounting frame that is greater than the distance which any portion of the rocker dimmer actuator extends from the mounting frame.

5. The electrical load control device according to claim 1, wherein the platform comprises a pair of opposing sides and a pair of opposing ends and wherein the sides are relatively long with respect to the ends.

6. The electrical load control device according to claim 5 wherein the platform defines a substantially planar actuator presentation surface that extends between the sides and the ends, the electrical load device further comprising an airgap switch actuator extending through the platform and supported for translation in a direction that is substantially perpendicular to the actuator presentation surface of the platform.

7. The electrical load control device according to claim 6 further comprising a pair of electrical contacts that are supported on switch leaf arms for normal contact with one another and wherein the airgap switch actuator comprises an elongated shaft and a wedge connected to the shaft, the wedge having cam surfaces that angle outwardly from the shaft, the cam surfaces contacting and separating the switch leaf arms thereby separating the electrical contacts during the translation of the airgap switch actuator.

8. The electrical load control device according to claim 1 wherein the dimmer actuator comprises a linear slide actuator received in an elongated slot in the platform.

9. The electrical load control device according to claim 1, wherein the platform defines a substantially planar actuator presentation surface from which a portion of the pushbutton actuator protrudes, and wherein the platform includes at least one opening in light communication with a light source, the at least one opening extending to the actuator presentation surface for presentation of light from the light source to a user of the device.

10. The electrical load control device according to claim 9 wherein the at least one opening includes a plurality of spaced openings.

11. The electrical load control device according to claim 10, wherein the plurality of spaced openings are arranged in an equally spaced linear array of openings.

12. The electrical load control device according to claim 1, wherein the surface of the user-engageable portion of the pushbutton actuator presents a color that contrasts with a color presented by the dimmer actuator, and wherein the color of the pushbutton actuator further contrasts with a color presented by at least a portion of the platform, the contrasting color of the pushbutton actuator visually targeting the pushbutton actuator thereby reducing the likelihood of undesirable coupling between the actuation of the pushbutton actuator and the actuation of the dimmer actuator.

13. The electrical load control device according to claim 1, wherein the surface of the user-engageable portion of the pushbutton actuator has a surface texture that is distinct from a surface texture of the dimmer actuator, and wherein the surface texture of the pushbutton actuator is distinct from a surface texture of at least a portion of the platform, the distinct surface texture of the pushbutton actuator visually targeting the pushbutton actuator thereby reducing the likelihood of undesirable coupling between the actuation of the pushbutton actuator and the actuation of the dimmer actuator.

14. The electrical load control device according to claim 1, wherein the pushbutton actuator further comprises a body portion having a first end and an opposite second end, the user-engageable portion of the pushbutton actuator connected to the first end of the body portion of the pushbutton actuator, and wherein the body portion of the pushbutton actuator has a cross section that is defined by a modified ellipse obtained by removing a middle portion of an ellipse and uniting remaining end portions of the ellipse to one another.

15. The electrical load control device according to claim 1, wherein the pushbutton actuator further comprises a body portion having a cross section and opposite first and second ends, the user-engageable portion of the pushbutton actuator connected to the first end of the body portion of the pushbutton actuator, and wherein the surface of the user-engageable portion of the pushbutton actuator is defined by a modified surface of revolution of the body portion cross section, the surface of revolution modified by elongating a middle portion of the user-engageable portion of the pushbutton actuator such that a distance that the middle portion of the user-engageable portion extends from the first end of the body portion of the user-engageable portion is increased.

16. The electrical load control device according to claim 15, wherein the surface of revolution of the body portion cross section that defines the surface of the user-engageable portion has been further modified by laterally widening a portion of the user-engageable portion so as not to present a relatively sharp edge to a user of the actuator.

17. The electrical load control device according to claim 1, wherein the pushbutton actuator further comprises a body portion having a cross section and opposite first and second ends, the user-engageable portion of the pushbutton actuator connected to the first end of the body portion of the pushbutton actuator, and wherein the surface of the user-engageable portion of the pushbutton actuator is defined by a modified surface of revolution of the body portion cross section, the surface of revolution modified by reducing the distance that at least a portion of each of opposite end portions of the user-engageable portion extends from the first end of the body portion of the pushbutton actuator.

18. The electrical load control device according to claim 1, wherein a portion of the user-engageable portion of the pushbutton actuator is transmissive to IR radiation to provide an IR window for passage of an IR signal through the user-engageable portion of the pushbutton actuator.

19. The electrical load control device according to claim 1, wherein the platform of the actuator mounting frame includes relatively long sides and relatively short ends and wherein the sides have a length that is less than 0.925 inches and the ends have a length that is less than 0.401 inches.

20. A dimmer switch adapted for use with a wallplate having a rectangular opening that has relatively long sides and relatively short ends, the dimmer switch comprising:

an actuator mounting frame comprising a substantially rectangular platform, the platform having relatively long sides and relatively short ends, the sides and ends dimensioned for receipt within the wallplate rectangular opening;

a dimmer actuator extending in a direction that is substantially parallel with respect to the platform sides; and a pushbutton actuator for a switch, the pushbutton actuator comprising an elongated user-engageable portion that extends adjacent the dimmer actuator in a direction that is substantially parallel with respect to the platform sides, the user-engageable portion of the pushbutton actuator defining a surface having opposite end portions, at least the end portions of surface of the user-engageable portion of the pushbutton actuator being defined by a portion of a substantially prolate spheroid to provide for minimization of undesirable coupling between the actuation of the pushbutton actuator and the actuation of the dimmer acutator.

21. The dimmer switch according to claim 20, wherein the dimmer actuator comprises a pivotably supported rocker dimmer actuator, the rocker dimmer actuator having a portion defining a curved surface that is presented to a user of the switch.

22. The dimmer switch according to claim 21, wherein the rocker dimmer actuator surface has opposite end portions and is substantially concave such that the end portions extend to a distance from the mounting frame that is greater than that for a middle portion of the rocker dimmer actuator surface.

23. The dimmer switch according to claim 20, wherein the dimmer actuator comprises a linear slide actuator received in an elongated slot in the platform.

24. The dimmer switch according to claim 20, wherein the platform defines a substantially planar actuator presentation surface that extends between the sides and ends of the platform, the dimmer switch further comprising an airgap switch actuator extending through the platform and supported for translation in a direction that is substantially perpendicular to the actuator presentation surface of the platform.

25. The dimmer switch according to claim 24, further comprising a pair of electrical contacts that are supported on switch leaf arms for normal contact with one another and wherein the airgap switch actuator comprises an elongated shaft and a wedge connected to the shaft, the wedge having cam surfaces that angle outwardly from the shaft, the cam surfaces contacting and separating the switch leaf arms thereby separating the electrical contacts during the translation of the airgap switch actuator.

26. The dimmer switch according to claim 20, wherein the platform defines a substantially planar actuator presentation surface from which a portion of the pushbutton actuator protrudes, and wherein the platform includes at least one opening in light communication with a light source, the at least one opening extending to the actuator presentation surface for presentation of light from the light source to a user of the switch.

27. The dimmer switch according to claim 26, wherein the at least one opening includes a plurality of openings that are arranged in a linear array of equally spaced openings.

28. The dimmer switch according to claim 20, wherein a portion of the user-engageable portion of the pushbutton actuator is transmissive to IR radiation to provide an IR window for passage of an IR signal through the user-engageable portion of the pushbutton actuator.

29. The dimmer switch according to claim 20, wherein the sides of the platform have a length that is less than 0.925 inches and the ends have a length that is less than 0.401 inches.

30. A dimmer switch for use with a wallplate having an opening that has standard toggle-type dimensions, the dimmer switch comprising:

a pushbutton actuator for actuating a switch, the pushbutton actuator comprising a user-engageable portion defining a surface that is presented to a user of the switch;

a dimmer actuator;

an independent actuator for an airgap switch;

an actuator mounting member having a surface defining an actuator presentation area, the actuator presentation area adapted for receipt by the wallplate opening to present the actuator presentation area to a user of the switch, at least a portion of each of the pushbutton actuator, dimmer actuator and airgap switch actuator contained within the actuator presentation area to provide accessibility for a user of the switch to the actuators; and at least one opening in the actuator mounting member extending to the surface of the actuator mounting member, the opening providing for light communication between the actuator mounting surface and a source of light to provide a lighted display to a user of the switch.

31. The dimmer switch according to claim 30, wherein the dimmer actuator comprises a pivotably supported rocker dimmer actuator.

32. The dimmer switch according to claim 30, wherein the at least one opening comprises a plurality of openings arranged in a linear array of openings to provide for an indication of dimmer level to a user of the dimmer switch.

33. The dimmer switch according to claim 30, wherein the actuator mounting member comprises a rectangular platform having relatively long sides and relatively short ends.

34. The dimmer switch according to claim 30, wherein the actuator presentation area has a length that is less than 0.925 inches and a width that is less than 0.401 inches.

35. The dimmer switch according to claim 30 wherein the surface of the user-engageable portion of the pushbutton actuator is defined by a portion of a substantially prolate spheroid.

36. The dimmer switch according to claim 30 wherein a portion of the user-engageable portion of the pushbutton actuator is transmissive to IR radiation to provide an IR window for passage of an IR signal through the user-engageable portion of the pushbutton actuator.

37. An electrical load control device for use with a wallplate having an opening that has standard toggle-type dimensions, the electrical load control device comprising:

an actuator mounting frame comprising a substantially rectangular platform, the platform adapted for receipt within the switch opening of a standard toggle-type wallplate;

a dimmer actuator that extends in a direction that is substantially parallel to a side of the platform; and a pushbutton actuator for a switch comprising a user-engageable portion that extends adjacent the dimmer actuator in a direction that is substantially parallel to the first side of the platform, the user-engageable portion defining a surface having opposite end portions that is presented to a user of the device, at least the end portions of the surface of the user-engageable portion being defined by a substantially hemi-ellipsoidal surface to provide for minimization of undesirable coupling between the adjacent actuators during actuation by a user.

38. A dimmer switch adapted for use with a wallplate having a rectangular opening that has relatively long sides and relatively short ends, the dimmer switch comprising:

an actuator mounting frame comprising a substantially rectangular platform, the platform having relatively long sides and relatively short ends, the sides and ends dimensioned for receipt within the wallplate rectangular opening;

a dimmer actuator extending in a direction that is substantially parallel with respect to the platform sides; and a pushbutton actuator for a switch, the pushbutton actuator comprising an elongated user-engageable portion that extends adjacent the dimmer actuator in a direction that is substantially parallel with respect to the platform sides, the user-engageable portion of the pushbutton actuator defining a surface having opposite end portions, at least the end portions of surface of the user-engageable portion of the pushbutton actuator being defined by a substantially hemi-ellipsoidal surface to provide for minimization of undesirable coupling between the actuation of the pushbutton actuator and the actuation of the dimmer actuator.

* * * * *